US005973657A

United States Patent [19]

Okada et al.

[11] Patent Number: 5,973,657

[45] Date of Patent: Oct. 26, 1999

[54] LIQUID CRYSTAL DISPLAY APPARATUS

[75] Inventors: Shinjiro Okada, Isehara; Yutaka Inaba, Kawaguchi; Kazunori Katakura, Atsugi, all of Japan

[73] Assignee: Canon Kabushiki Kaisha, Tokyo, Japan

[21] Appl. No.: 08/543,527

[22] Filed: Oct. 16, 1995

Related U.S. Application Data

[63] Continuation of application No. 08/166,946, Dec. 15, 1993, abandoned.

[30] Foreign Application Priority Data

Dec. 28, 1992 [JP] Japan ..... 4-358843

[51] Int. Cl.[6] ..... G09G 3/36

[52] U.S. Cl. ..... 345/89; 345/100

[58] Field of Search ..... 345/89, 90, 98, 345/93, 99, 100, 101, 147, 152, 126

[56] References Cited

U.S. PATENT DOCUMENTS

| | | | |
|---|---|---|---|
| 4,367,924 | 1/1983 | Clark et al. | 350/334 |
| 4,563,059 | 1/1986 | Clark et al. | 350/330 |
| 4,639,089 | 1/1987 | Okada et al. | 350/341 |
| 4,655,561 | 4/1987 | Kanbe et al. | 350/350 S |
| 4,681,404 | 7/1987 | Okada et al. | 350/350 S |
| 4,792,981 | 12/1988 | Cahill, III et al. | 345/126 |
| 4,815,823 | 3/1989 | Kaneko | 350/336 |
| 4,836,656 | 6/1989 | Mouri et al. | 350/350 S |
| 4,923,285 | 5/1990 | Ogino et al. | 350/331 T |
| 5,062,001 | 10/1991 | Farwell et al. | 345/152 |
| 5,136,282 | 8/1992 | Inaba et al. | 340/784 |
| 5,267,065 | 11/1993 | Taniguchi et al. | 359/56 |
| 5,298,913 | 3/1994 | Numao et al. | 345/100 |
| 5,581,273 | 12/1996 | Yoneda et al. | 345/98 |

FOREIGN PATENT DOCUMENTS

| | | | |
|---|---|---|---|
| 56-107216 | 8/1986 | Japan | G02F 1/137 |

OTHER PUBLICATIONS

Applied Physics Letters vol. 36, No. 11 (Jun. 1, 1980) pp. 899–901.

N.A. Clark, et al., MCLC (1983), vol. 94, pp. 213–234.

*Primary Examiner*—Amare Mengistu

*Attorney, Agent, or Firm*—Fitzpatrick, Cella, Harper & Scinto

[57] ABSTRACT

A liquid crystal display device is constituted by a pair of oppositely disposed electrode plates having thereon a group of scanning lines and a group of data lines, respectively, and a liquid crystal disposed between the pair of electrode plates so as to form a pixel at each intersection of the scanning lines and data lines. The display device is driven by sequentially selecting the scanning lines, and applying data signals to the data lines for the selected scanning lines. During the drive, the data signals applied to the data lines for pixels on a selected scanning line are determined while comprising image data for the pixels on the selected scanning line and image data for corresponding pixels on a subsequently selected scanning lines.

8 Claims, 15 Drawing Sheets

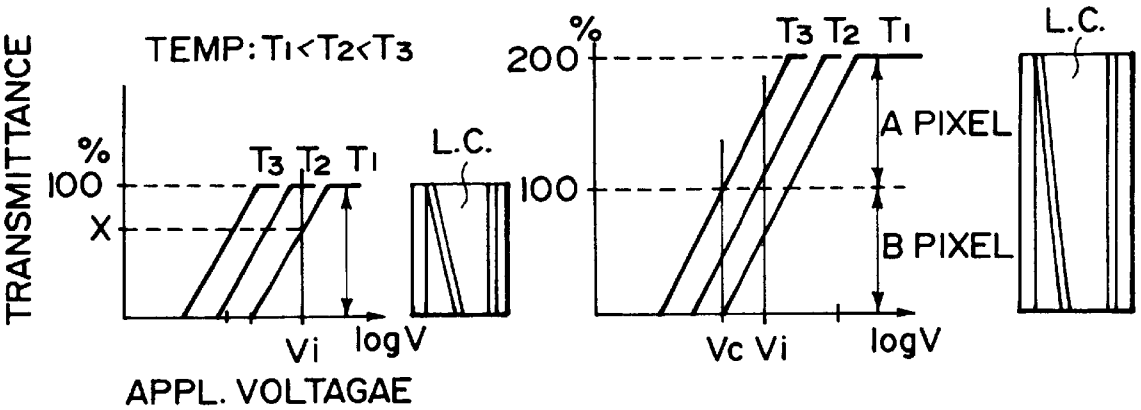
FIG. 7A
FIG. 7B
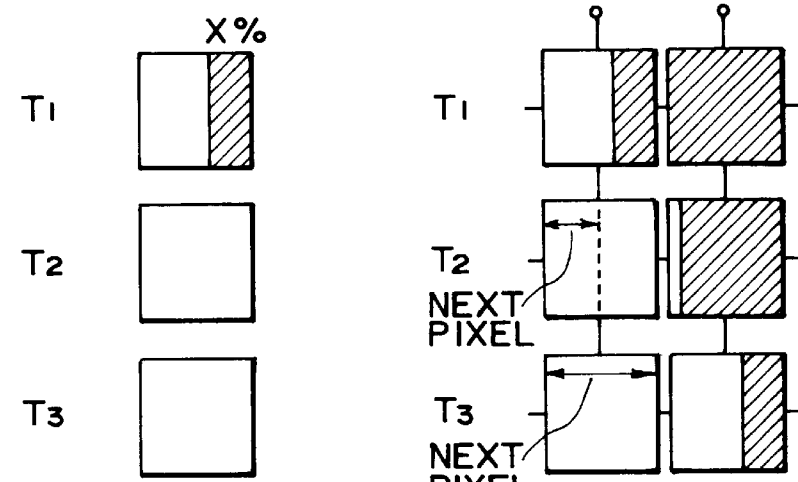
FIG. 7C
FIG. 7D

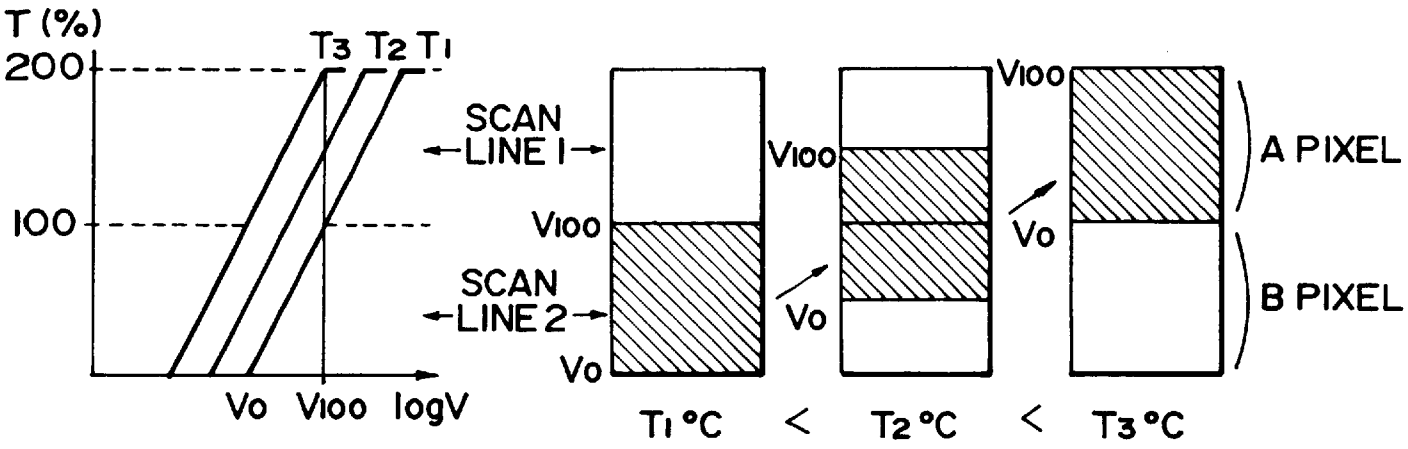
FIG. 8A
FIG. 8B
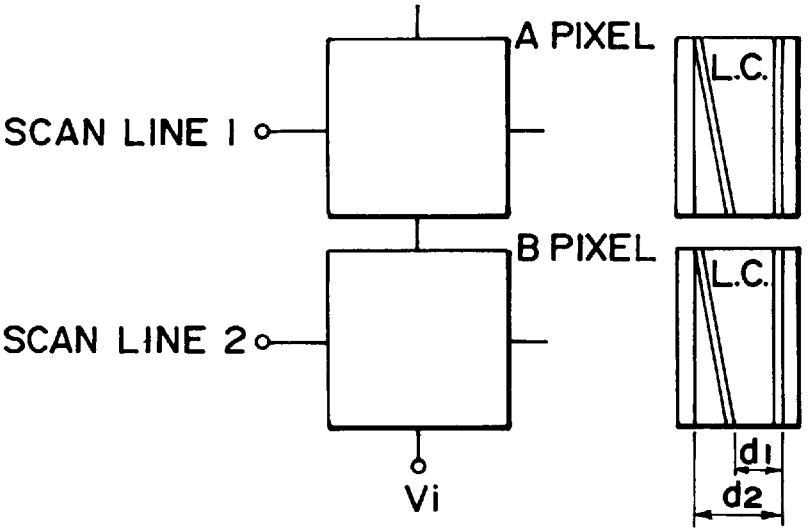
FIG. 9A
FIG. 9B

LIQUID CRYSTAL DISPLAY APPARATUS

This application is a continuation of application Ser. No. 08,166,946 filed Dec. 15, 1993, now abandoned.

FIELD OF THE INVENTION AND RELATED ART

The present invention relates to a liquid crystal display apparatus for computer terminals, television receivers, word processors, typewriters, etc., inclusive of a light valve for projectors, a view finder for video camera recorders, etc.

There have been known liquid crystal display devices including those using twisted-nematic (TN) liquid crystals, guest-host-type liquid crystals, smectic (Sm) liquid crystals, etc.

In a liquid crystal device, such a liquid crystal is disposed between a pair of substrates and changes an optical transmittance therethrough depending on voltages applied thereto. The electric field applied to the liquid crystal layer changes depending on the thickness of the liquid crystal layer, i.e., the spacing between the substrates.

Clark and Lagerwall have disclosed a bistable ferroelectric liquid crystal device using a surface-stabilized ferroelectric liquid crystal in, e.g., Applied Physics Letters, Vol. 36, No. 11 (Jun. 1, 1980), p.p. 899–901; Japanese Laid-Open Patent Application (JP-A) 56-107216, U.S. Pat. Nos. 4,367,924 and 4,563,059. Such a bistable ferroelectric liquid crystal device has been realized by disposing a liquid crystal between a pair of substrates disposed with a spacing small enough to suppress the formation of a helical structure inherent to liquid crystal molecules in chiral smectic C phase (SmC*) or H phase (SmH*) of bulk state and align vertical (smectic) molecular layers each comprising a plurality of liquid crystal molecules in one direction.

Further, as a display device using such a ferroelectric liquid crystal (FLC), there is known-one wherein a pair of-transparent substrates respectively having thereon a transparent electrode and subjected to an aligning treatment are disposed to be opposite to each other with a cell gap of about 1–3 $\mu$m therebetween so that their transparent electrodes are disposed on the inner sides to form a blank cell, which is then filled with a ferroelectric liquid crystal, as disclosed in U.S. Pat. Nos. 4,639,089; 4,655,561; and 4,681,404.

The above-type of liquid crystal display device using a ferroelectric liquid crystal has two advantages. One is that a ferroelectric liquid crystal has a spontaneous polarization so that a coupling force between the spontaneous polarization and an external electric field can be utilized for switching. Another is that the long axis direction of a ferroelectric liquid crystal molecule corresponds to the direction of the spontaneous polarization in a one-to-one relationship so that the switching is effected by the polarity of the external electric field. More specifically, the ferroelectric liquid crystal in its chiral smectic phase show bistability, i.e., a property of assuming either one of a first and a second optically stable state depending on the polarity of an applied voltage and maintaining the resultant state in the absence of an electric field. Further, the ferroelectric liquid crystal shows a quick response to a change in applied electric field. Accordingly, the device is expected to be widely used in the field of e.g., a high-speed and memory-type display apparatus.

A ferroelectric liquid crystal generally comprises a chiral smectic liquid crystal (SmC* or SmH*), of which molecular long axes form helixes in the bulk state of the liquid crystal. If the chiral smectic liquid crystal is disposed within a cell having a small gap of about 1–3 $\mu$m as described above, the helixes of liquid crystal molecular long axes are unwound (N. A. Clark, et al., MCLC (1983), Vol. 94, p.p. 213–234).

A liquid crystal display apparatus having a display panel constituted by such a ferroelectric liquid crystal device may be driven by a multiplexing drive scheme as described in U.S. Pat. No. 4,655,561, issued to Kanbe et al to form a picture with a large capacity of pixels. The liquid crystal display apparatus may be utilized for constituting a display panel suitable for, e.g., a word processor, a personal computer, a micro-printer, and a television set.

A ferroelectric liquid crystal has been principally used in a binary (bright-dark) display device in which two stable states of the liquid crystal are used as a light-transmitting state and a light-interrupting state but can be used to effect a multi-value display, i.e., a halftone display. In a halftone display method, the areal ratio between bistable states (light transmitting state and light-interrupting state) within a pixel is controlled to realize an intermediate light-transmitting state. The gradational display method of this type (hereinafter referred to as an "areal modulation" method) will now be described in detail.

FIG. 1 is a graph schematically representing a relationship between a transmitted light quantity I through a ferroelectric liquid crystal cell and a switching pulse voltage V. More specifically, FIG. 1A shows plots of transmitted light quantities I given by a pixel versus voltages V when the pixel initially placed in a complete light-interrupting (dark) state is supplied with single pulses of various voltages V and one polarity as shown in FIG. 1B. When a pulse voltage V is below threshold Vth (V<Vth), the transmitted light quantity does not change and the pixel state is as shown in FIG. 2B which is not different from the state shown in FIG. 2A before the application of the pulse voltage. If the pulse voltage V exceeds the threshold Vth (Vth<V<Vsat), a portion of the pixel is switched to the other stable state, thus being transitioned to a pixel state as shown in FIG. 2C showing an intermediate transmitted light quantity as a whole. If the pulse voltage V is further increased to exceed a saturation value Vsat (Vsat<V), the entire pixel is switched to a light-transmitting state as shown in FIG. 2D so that the transmitted light quantity reaches a constant value (i.e., is saturated). That is, according to the areal modulation method, the pulse voltage V applied to a pixel is controlled within a range of Vth<V<Vsat to display a halftone corresponding to the pulse voltage.

However, actually, the voltage (V)-transmitted light quantity (I) relationship shown in FIG. 1 depends on the cell thickness and temperature. Accordingly, if a display panel is accompanied with an unintended cell thickness distribution or a temperature distribution, the display panel can display different gradation levels in response to a pulse voltage having a constant voltage.

FIG. 3 is a graph for illustrating the above phenomenon which is a graph showing a relationship between pulse voltage (V) and transmitted light quantity (I) similar to that shown in FIG. 1 but showing two curves including a curve H representing a relationship at a high temperature and a curve L at a low temperature. In a display panel having a large display size, it is rather common that the panel is accompanied with a temperature distribution. In such a case, however, even if a certain halftone level is intended to be displayed by application of a certain drive voltage Vap, the resultant halftone levels can be fluctuated within the range of $I_1$ to $I_2$ as shown in FIG. 3 within the same panel, thus failing to provide a uniform gradational display state.

In order to solve the above-mentioned problem, our research and development group has already proposed a drive method (hereinafter referred to as the four pulse method") in U.S. patent appln. Ser. No. 681,933, filed Apr. 8, 1991. In the four pulse method, as illustrated in FIGS. 4 and 5, all pixels having mutually different thresholds on a common scanning line in a panel are supplied with plural pulses (corresponding to pulses (A)–(D) in FIG. 4) to show consequently identical transmitted quantities as shown at FIG. 4(D). In FIG. 5, $T_1$, $T_2$ and $T_3$ denote selection periods set in synchronism with the pulses (B), (C) and (D), respectively. Further, $Q_0$, $Q_0'$, $Q_1$, $Q_2$ and $Q_3$ in FIG. 4 represent gradation levels of a pixel, inclusive of $Q_0$ representing black (0%) and $Q_0'$ representing white (100%). Each pixel in FIG. 4 is provided with a threshold distribution within the pixel increasing from the leftside toward the right side as represented by a cell thickness increase.

Our research and development group has also proposed a drive method (a so-called "pixel shift method", as disclosed in U.S. patent appln. Ser. No. 984,694, filed Dec. 2, 1991 and entitled "LIQUID CRYSTAL DISPLAY APPARATUS"), requiring a shorter writing time than in the four pulse method. In the pixel shift method, plural scanning lines are simultaneously supplied with different scanning signals for selection to provide an electric field intensity distribution spanning the plural scanning lines, thereby effecting a gradational display. According to this method, a variation in threshold due to a temperature variation can be absorbed by shifting a writing region over plural scanning lines.

An outline of the pixel shift method will now be described below.

A liquid crystal cell (panel) suitably used may be one having a threshold distribution within one pixel. Such a liquid crystal cell may for example have a sectional structure as shown in FIG. 6. The cell shown in FIG. 6 has an FLC layer 55 disposed between a pair of glass substrates 53 including one having thereon transparent stripe electrodes 53 constituting data lines and an alignment film 54 and the other having thereon a ripple-shaped film 52 of, e.g., an insulating resin, providing a saw-teeth shape cross section, transparent stripe electrodes 52 constituting scanning lines and an alignment film 54. In the liquid crystal cell, the FLC layer 55 between the electrodes has a gradient in thickness within one pixel so that the switching threshold of FLC is also caused to have a distribution. When such a pixel is supplied with an increasing voltage, the pixel is gradually switched from a smaller thickness portion to a larger thickness portion.

The switching behavior is illustrated with reference to FIG. 7A. Referring to FIG. 7A, a panel in consideration is assumed to have portions having temperatures $T_1$, $T_2$ and $T_3$. The switching threshold voltage of FLC is lowered at a higher temperature. FIG. 7A shows three curves each representing a relationship between applied voltage and resultant transmittance at temperature $T_1$, $T_2$ or $T_3$.

Incidentally, the threshold change can be caused by a factor other than a temperature change, such as a layer thickness fluctuation, but an embodiment of the present invention will be described while referring to a threshold change caused by a temperature change, for convenience of explanation.

As is understood from FIG. 7A, when a pixel at a temperature $T_1$ is supplied with a voltage Vi, a transmittance of X% results at the pixel. If, however, the temperature of the pixel is increased to $T_2$ or $T_3$, a pixel supplied with the same voltage Vi is caused to show a transmittance of 100%, thus failing to perform a normal gradational display. FIG. 7C shows inversion states of pixels after writing. Under such conditions, written gradation data is lost due to a temperature change, so that the panel is applicable to only a limited use of display device.

In contrast thereto, it becomes possible to effect a gradational display stable against a temperature change by display data for one pixel on two scanning lines S1 and S2 as shown in FIG. 7D.

The drive scheme will be described in further detail hereinbelow.

(1) A ferroelectric liquid crystal cell as shown in FIG. 12 having a continuous threshold distribution within each pixel is provided. It is also possible to use a cell structure providing a potential gradient within each pixel as proposed by our research and development group in U.S. Pat. No. 4,815,823 or a cell structure having a capacitance gradient. In any way, by providing a continuous threshold distribution within each cell, it is possible to form a domain corresponding to a bright state and a domain corresponding to a dark state in mixture within one pixel, so that a gradational display becomes possible by controlling the areal ratio between the domains.

The method is applicable to a stepwise transmittance modulation (e.g., at 16 levels) but a continuous transmittance modulation is required for an analog gradational display.

(2) Two scanning lines are selected simultaneously. The operation is described with reference to FIG. 8. FIG. 8A shows an overall transmittance—applied voltage characteristic for combined pixels on two scanning lines. In FIG. 8A, a transmittance of 0–100% is allotted to be displayed by a pixel B on a scanning line 2 and a transmittance of 100–200% is allotted to be displayed by a pixel A on a scanning line 1. More specifically, as one pixel is constituted by one scanning line, a transmittance of 200% is displayed when both the pixels A and B are wholly in a transparent state by scanning two scanning lines simultaneously. Herein, two scanning lines are selected for displaying one gradation data but a region having an area of one pixel is allotted to displaying one gradation data. This is explained with reference to FIG. 8B.

At temperature $T_1$, inputted gradation data is written in a region corresponding to 0% at an applied voltage $V_0$ and in a region corresponding to 100% at $V_{100}$. As shown in FIG. 8B, at temperature $T_1$, the range (pixel region) is wholly on the scanning line 2 (as denoted by a hatched region in FIG. 8B). When the temperature is raised from $T_1$ to $T_2$, however, the threshold voltage of the liquid crystal is lowered correspondingly, the same amplitude of voltage causes an inversion in a larger region in the pixel than at temperature $T_1$.

For correcting the deviation, a pixel region at temperature $T_2$ is set to span on scanning lines 1 and 2 (a hatched portion at $T_2$ in FIG. 8B).

Then, when the temperature is further raised to temperature $T_3$, a pixel region corresponding to an applied voltage in the range of $V_0$–$V_{100}$ is set to be on only the scanning line 1 (a hatched portion at $T_3$ in FIG. 8B).

By shifting the pixel region for a gradational display on two scanning lines depending on the temperature, it becomes possible to retain a normal gradation display in the temperature region of $T_1$–$T_3$.

(3) Different scanning signals are applied to the two scanning lines selected simultaneously. As described at (2)

above, in order to compensate for the change in threshold of liquid crystal inversion due to a temperature range by selecting two scanning lines simultaneously, it is necessary to apply different scanning signals to the two selected scanning lines. This point is explained with reference to FIG. 7.

Scanning signals applied to scanning lines 1 and 2 are set so that the threshold of a pixel B on the scanning line 2 and the threshold of a pixel A on the scanning line 1 varies continuously. Referring to FIG. 7B, a transmittance-voltage curve at temperature 1 indicates that a transmittance up to 100% is displayed in a region on the scanning line 2 and a transmittance thereabove and up to 200% is displayed in a region on the scanning line 1. It is necessary to set the transmittance curve so that it is continuous and has an equal slope spanning from the pixel B to the pixel A.

As a result, even if the pixel A on the scanning line 1 and the pixel B on the scanning line 2 are set to have identical cell shapes as shown in FIG. 9B, it becomes possible to effect a display substantially similar to that in the case where the pixel A and the pixel B are provided with a continuous threshold characteristic (cell at the right side of FIG. 7B).

If a cell including pixels each having a threshold distribution as shown in FIG. 6 is supplied with a voltage waveform as shown in FIG. 10A<a gradation level formed by application of a writing pulse $V_1$ is affected by application of subsequent alternating pulses ±Vc.

The value |Vc| is below an inversion threshold at a pulse width of 40 μμm (FIG. 10A), so that, if the pulses ±Vc are applied not immediately after the writing but in the absence of the pulse $V_1$, the reset state given by the pulse $V_0$ is displayed as it is without being accompanied with any change (crosstalk). The quantity or level of change (hereinafter referred to as "crosstalk") affecting the written level varies depending on the peak value of Vc even if $V_1$ and $V_0$ are the same. More specifically, the crosstalk quantity increases as the value |Vc| increases as shown in FIG. 10B, amounting to 20% or more at |Vc|=5 volts. As a result, in case where some alternating signals are applied after a writing pulse, it is difficult to drive a matrix electrode cell by a line-sequential writing drive (FIG. 10C).

The characteristics of a liquid crystal device referred to above with reference to FIGS. 10A–10C are identical to those used in Example described hereinafter inclusive of the cell structure and materials. The crosstalk may be attributable to instability of FLC immediately after the switching. When the light quantity change through FLC immediately after switching was examined and the result was as shown in FIG. 11A, showing a continual change in light quantity for some time and resulting in a certain stable quantity level. The stabilization of optical response required a time (hereinafter referred to as "relaxation time") of about 200 μs.

When a drive waveform as shown in FIG. 11C was used to examine the relationship between the relaxation time and the crosstalk, a graph as shown in FIG. 11B was obtained. The waveform shown in FIG. 11C includes a writing pulse $V_{ON}$ and a reset pulse $-V_0$. FIG. 11B shows a change in final transmittance when crosstalk pulses ±Vc were applied after lapse of time T after the fall down of the $V_{ON}$ pulse. FIG. 11B shows that the crosstalk quantity varies depending on the value of T even if |Vc| is fixed at 5 volts and the effect of the pulses ±Vc is substantially lost under the condition of T≧relaxation time (=200 μs). The crosstalk quantity (change in transmittance) can change depending on the number of crosstalk pulses after the $V_{ON}$ pulse in the case of a drive waveform as shown in FIG. 12A. FIG. 12B however shows that the crosstalk quantity is not affected if the total time of the number of the pulses exceeds the relaxation time, i.e., showing that N≧Z (≧200 μs) provides a substantially constant final transmittance.

Accordingly, in the case of gradational display, it is an important problem how to treat non-selection signals applied after a switching pulse. As a measure, it is possible to prevent the crosstalk by not applying such non-selection signals for a period corresponding to the relaxation time after the writing. This however requires a long one line-selection time and is not suitable for other than a static picture display, thus being impractical.

SUMMARY OF THE INVENTION

Accordingly, an object of the present invention is to provide a practical liquid crystal display apparatus capable of obviating the crosstalk caused by application of non-selecting signals after writing.

As a result of our study, it has been found possible to suppress the crosstalk (i.e., change in written gradation level) in a line-sequential scanning of an FLC panel by applying appropriate data signals based on estimated crosstalk quantity caused by detected contents of data written on a subsequent scanning line.

More specifically, according to the present invention, there is provided a liquid crystal display apparatus, including:

a liquid crystal display device comprising a pair of oppositely disposed electrode plates having thereon a group of scanning lines and a group of data lines, respectively, and a liquid crystal disposed between the pair of electrode plates so as to form a pixel at each intersection of the scanning lines and data lines, and drive means including means for sequentially selecting the scanning lines, means for applying data signals to the data lines for the selected scanning lines, and control means for determining the data signals applied to the data lines for pixels on a selected scanning line while comparing image data for the pixels on the selected scanning line and image data for corresponding pixels on a subsequently selected scanning lines.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 7A–7D are views for illustrating a pixel shift method.

FIGS. 8A, 8B, 9A and 9B are other views for illustrating a pixel shift method.

DESCRIPTION OF THE PREFERRED EMBODIMENTS

Examination of the crosstalk encountered in gradational display using a ferroelectric liquid crystal (FLC) device has revealed the following characteristics.

Figure 10A:
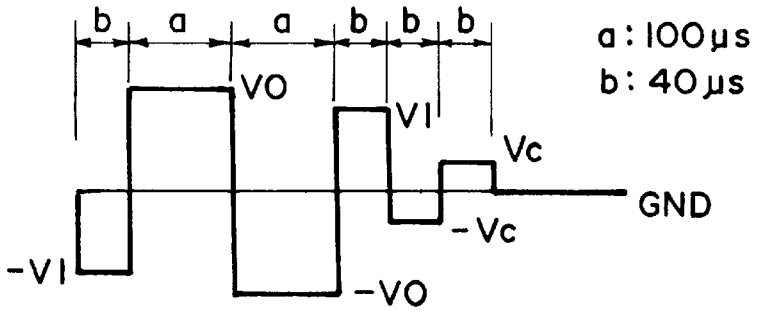
FIGS. 10A–10C, 11A–11C and 12A–12B are waveform diagrams and graphs for illustrating the problem (crosstalk) to be solved by the invention.
Figure 10B:
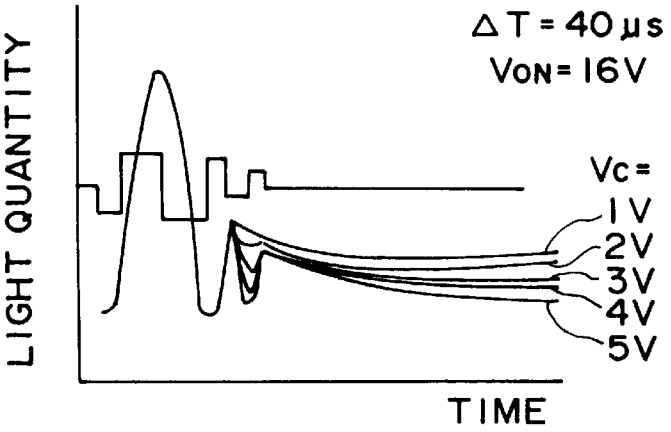
Figure 10C:
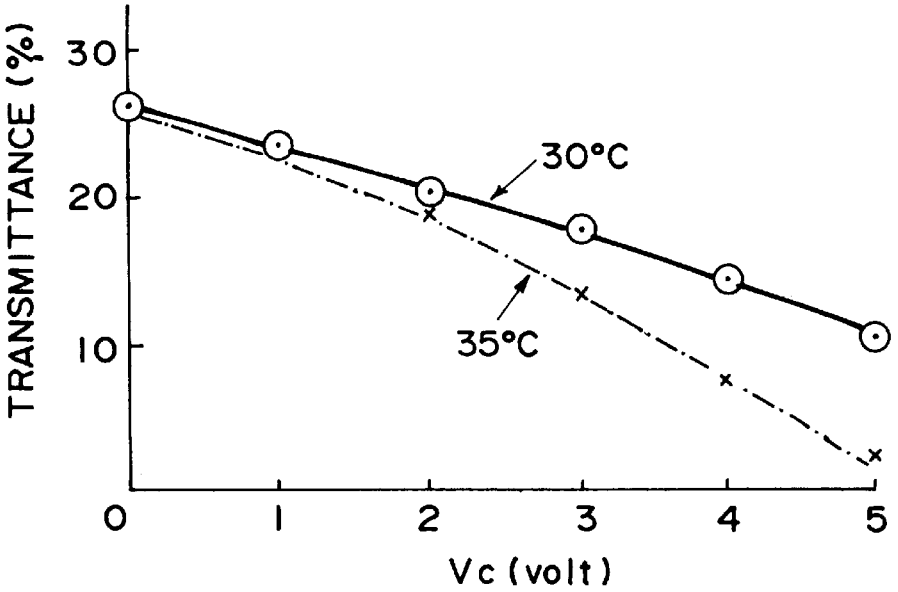
Figure 11A:
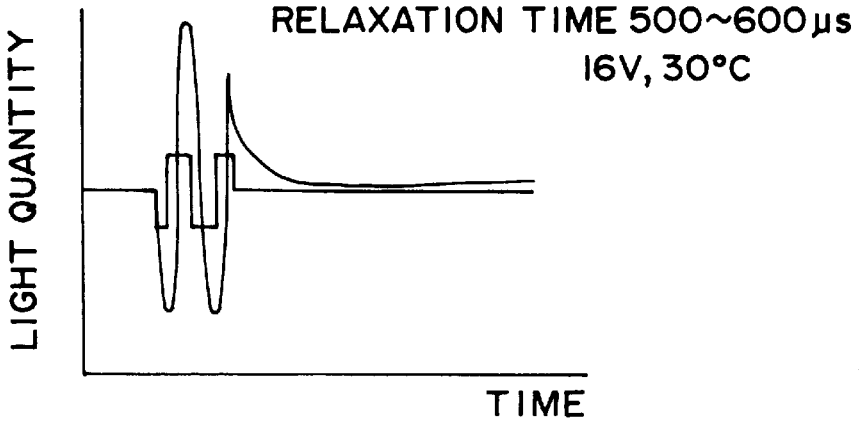
Figure 11B:
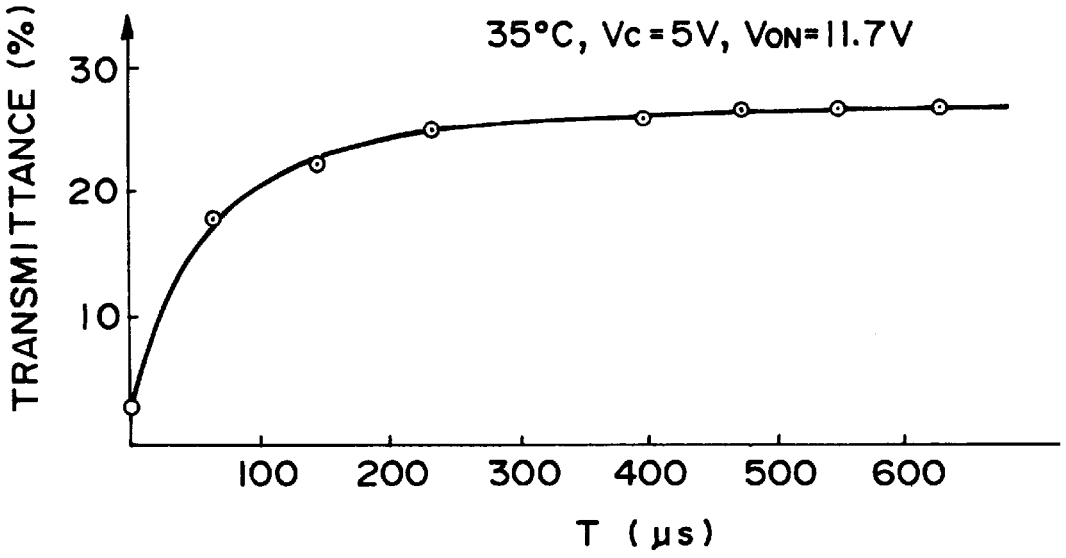
Figure 11C:
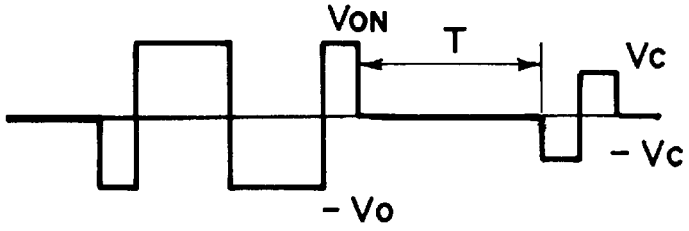
Figure 13:
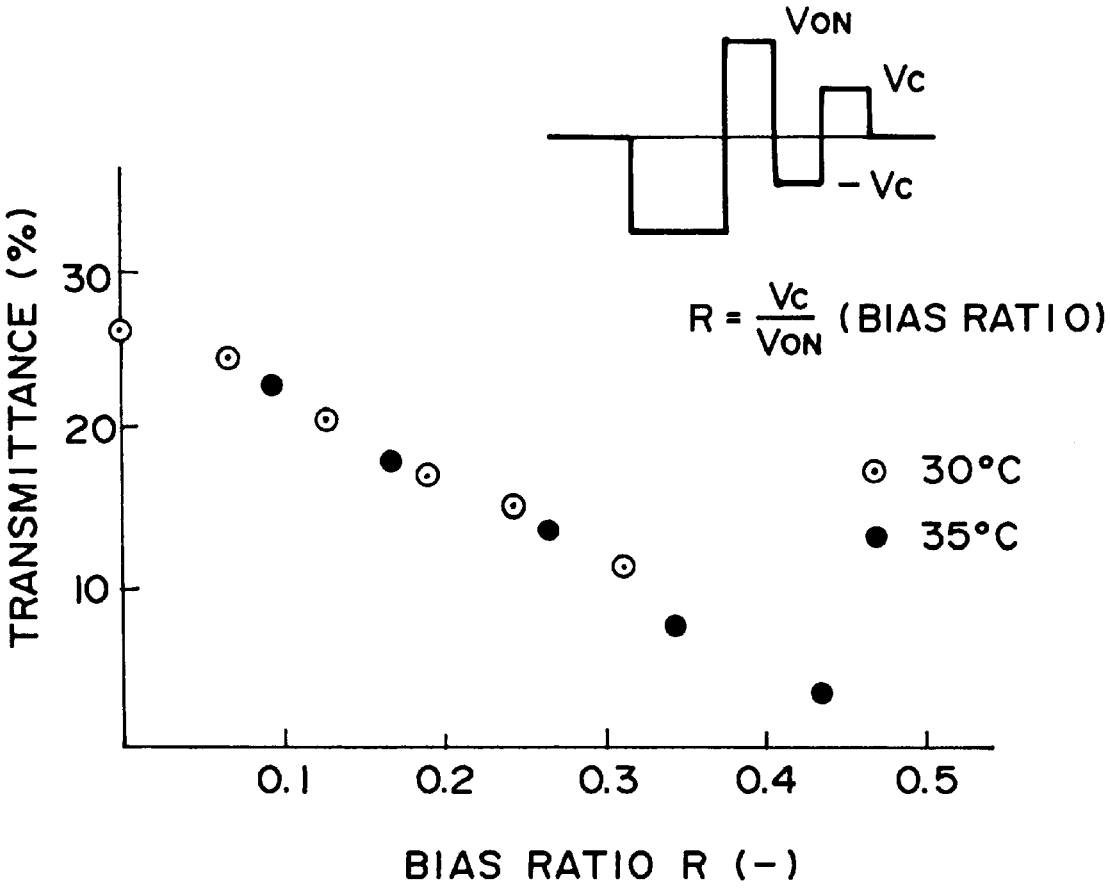
FIG. 13 is a graph showing a relationship between transmittance and bias ratio.

Referring to FIG. 10C, if the change in crosstalk quantity from the same gradation level (at Vc=0 volt) according to increased ±Vc is examined, it is seen that different crosstalk quantities are observed at 30° C. and 35° C. The applied voltages VON ($=V_1$) at that time were 16 volts at 30° C. and 11.7 volts at 35° C. However, if the varying crosstalk voltages Vc were normalized by a bias ratio $R=Vc/V_{ON}$, the transmittance change according to the varying crosstalk voltage could be represented by a substantially signal line regardless of the temperature difference as shown in FIG. 13.

Figure 14:
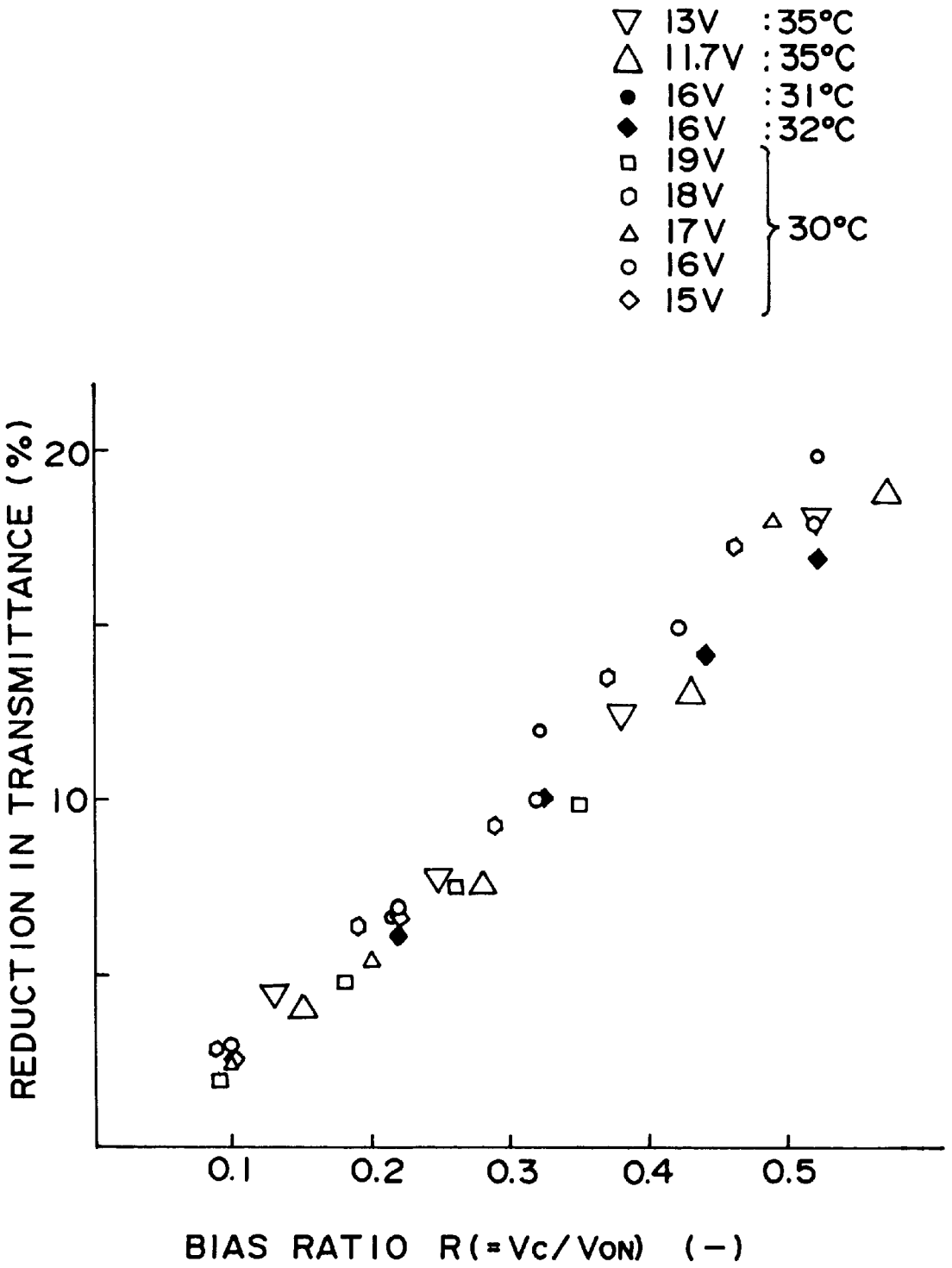
FIG. 14 is a graph showing a relationship between reduction in transmittance and bias ratio at various temperatures.
Figure 15:
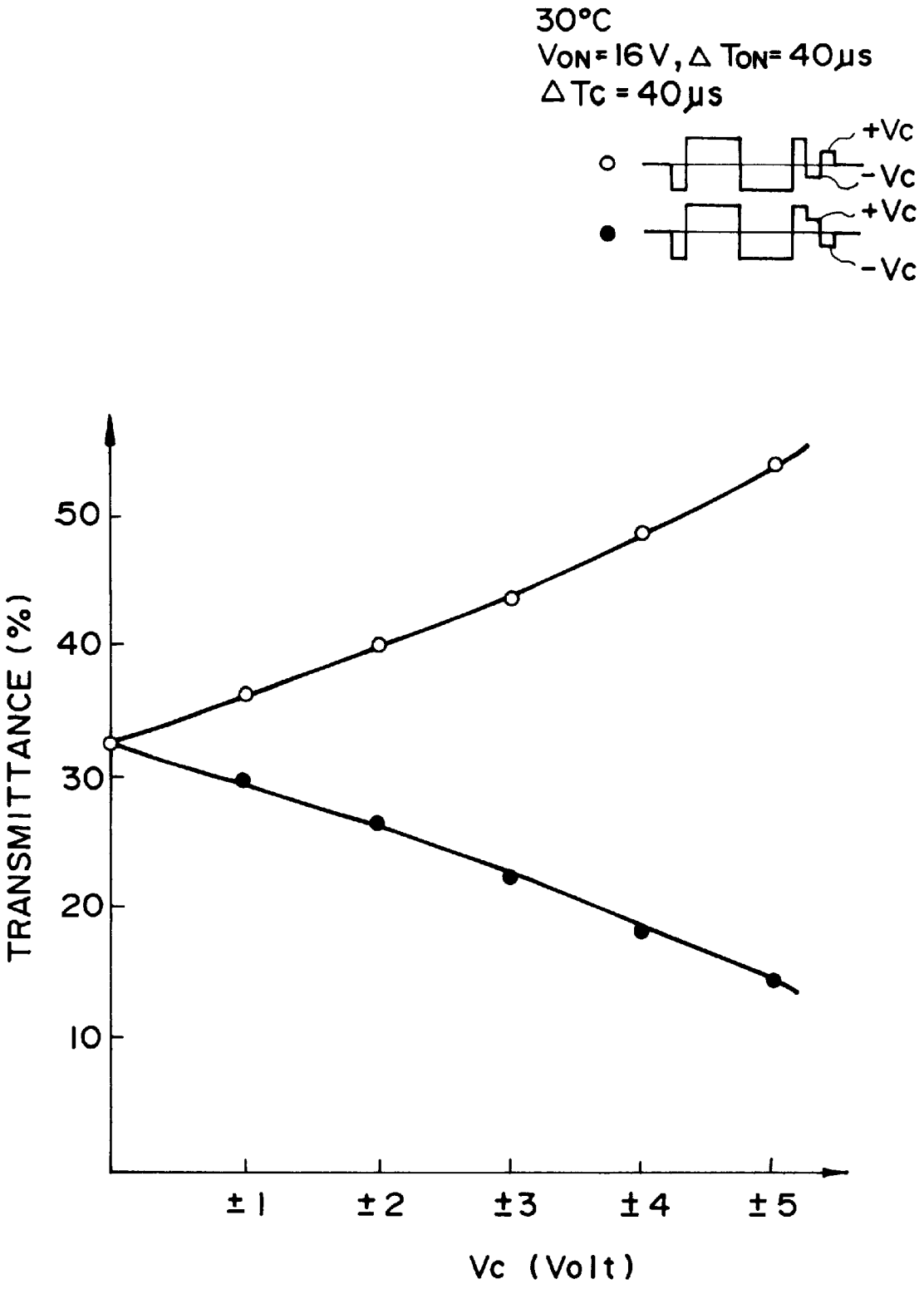
FIG. 15 is a graph showing a relationship between transmittance and crosstalk voltage (Vc).

Further, as shown in FIG. 14, the relationship between the crosstalk quantity (reduction in transmittance) and the bias ratio R ($=Vc/V_{ON}$) could be represented as a substantially single linear relationship without depending on the writing levels (values of $V_{ON}$). Further, as shown in FIG. 15, if the signs of alternating pulses ±Vc after the $V_{ON}$ pulse were altered, the sign of the crosstalk quality was also altered. More specifically, in the case where $V_{ON}$ was positive, the application sequence of +Vc pulse and then −Vc pulse resulted in an enhancement in the written level, and the application sequence of −Vc pulse and then +Vc pulse resulted in an reduction in the written level.

As described above, (1) the crosstalk quantity is determined by the bias ratio and does not depend on the temperature or the gradation level, and (2) the change in light quantity (transmittance) due to the crosstalk remarkably depends on the pattern of subsequent pulses following the writing pulse $V_{ON}$. These characteristics indicate that it is possible to completely compensate for the crosstalk quantity and design data signals (inclusive of pulse widths and amplitudes) for one frame or several lines while taking the crosstalk quantity into consideration, in case where the above-mentioned pixel shift method is applicable and subsequent display data are known Based on the above knowledge, the present invention provides an FLC data line based on a system capable of recognizing subsequent data and arranging data signals for one frame based thereon. It is also possible to design data signals for not only one frame but also a subsequent frame. it is also effective to preliminarily set subsequent signals at a prescribed value.

EXAMPLE 1

Figure 6:
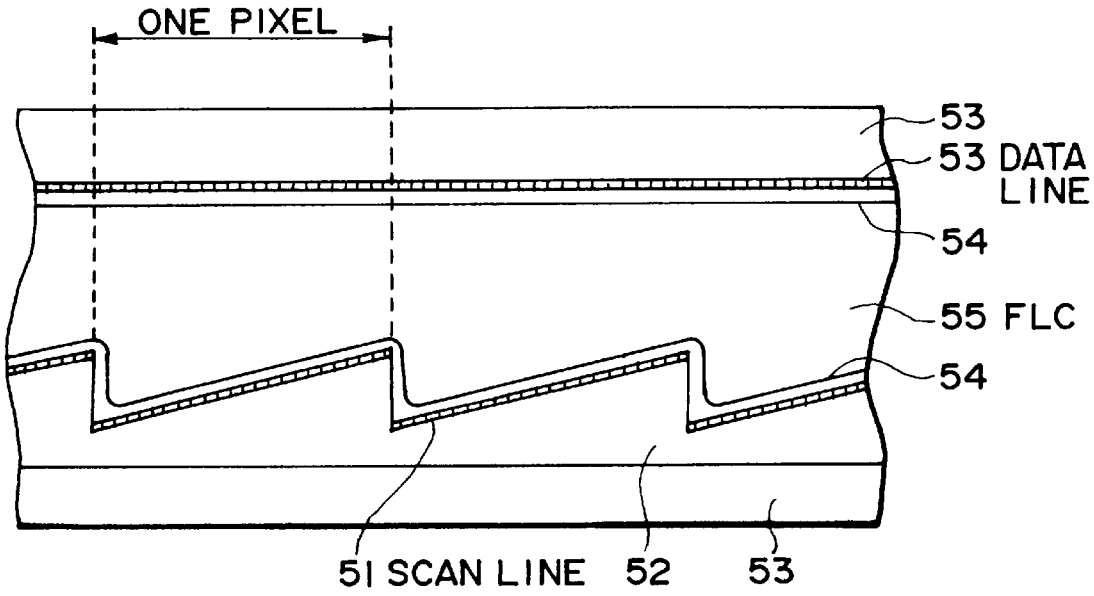
FIG. 6 is a schematic sectional view of a liquid crystal cell applicable to the invention.

As a first embodiment, a liquid crystal cell having a sectional structure as shown in FIG. 6 was prepared. The lower glass substrate 53 was provided with a saw-teeth shape cross section by transferring an original pattern formed on a mold onto a UV-curable resin layer applied thereon to form a cured acrylic resin layer 52.

The thus-formed UV-cured uneven resin layer 52 was then provided with stripe electrodes 51 of ITO film by sputtering and then coated with an about 300Å-thick alignment film (formed with "LQ-1802", available from Hitachi Kasei K.K.).

The opposite glass substrate 53 was provided with stripe electrodes 51 of ITO film on a flat inner surface and coated with an identical alignment film.

Both substrates (more accurately, the alignment films thereon) were rubbed respectively in one direction and superposed with each other so that their rubbing directions were roughly parallel but the rubbing direction of the lower substrate formed a clockwise angle of about 6 degrees with respect to the rubbing direction of the upper substrate. The cell thickness (spacing) was controlled to be from about 1.0 μm as the smallest thickness to about 1.4 μm as the largest thickness. Further, the lower stripe electrodes 51 were formed along the ridge or ripple (extending in the thickness direction of the drawing) so as to provide one pixel width having one saw tooth span. Thus, rectangular pixels each having a size of 300 μm×200 μm were formed.

Then, the cell was filled with a chiral smectic liquid crystal A showing the following phase transition series and properties.

TABLE 1

(liquid crystal A)

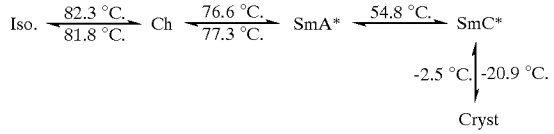

Ps = −5.8 nC/cm$^2$ (30° C.)
Tilt angle = 14.3 deg. (30° C.)
$\Delta\epsilon \approx -0$ (30° C.)

Figure 16:
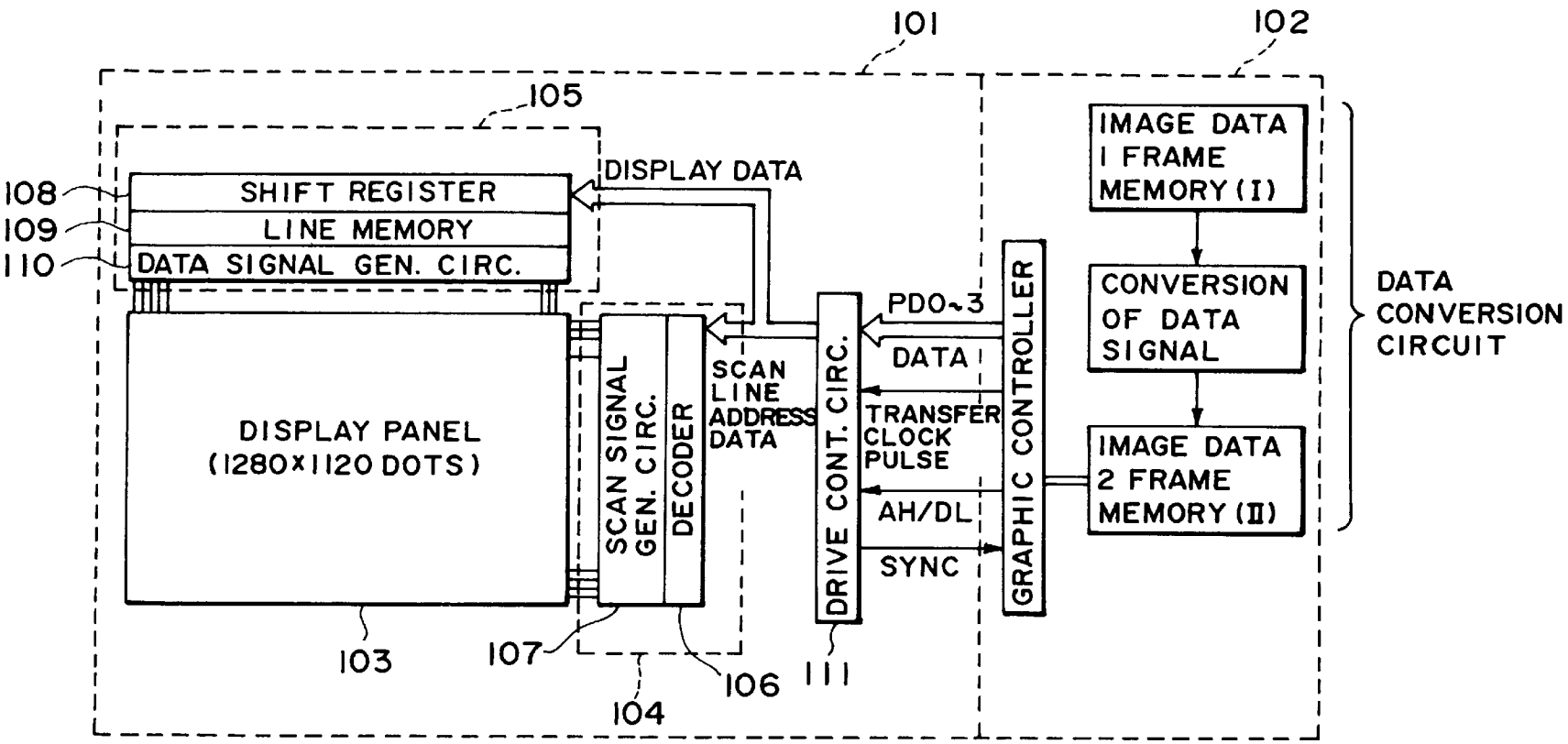
FIG. 16 is a block diagram of a drive circuit applicable to the invention.
Figure 19:
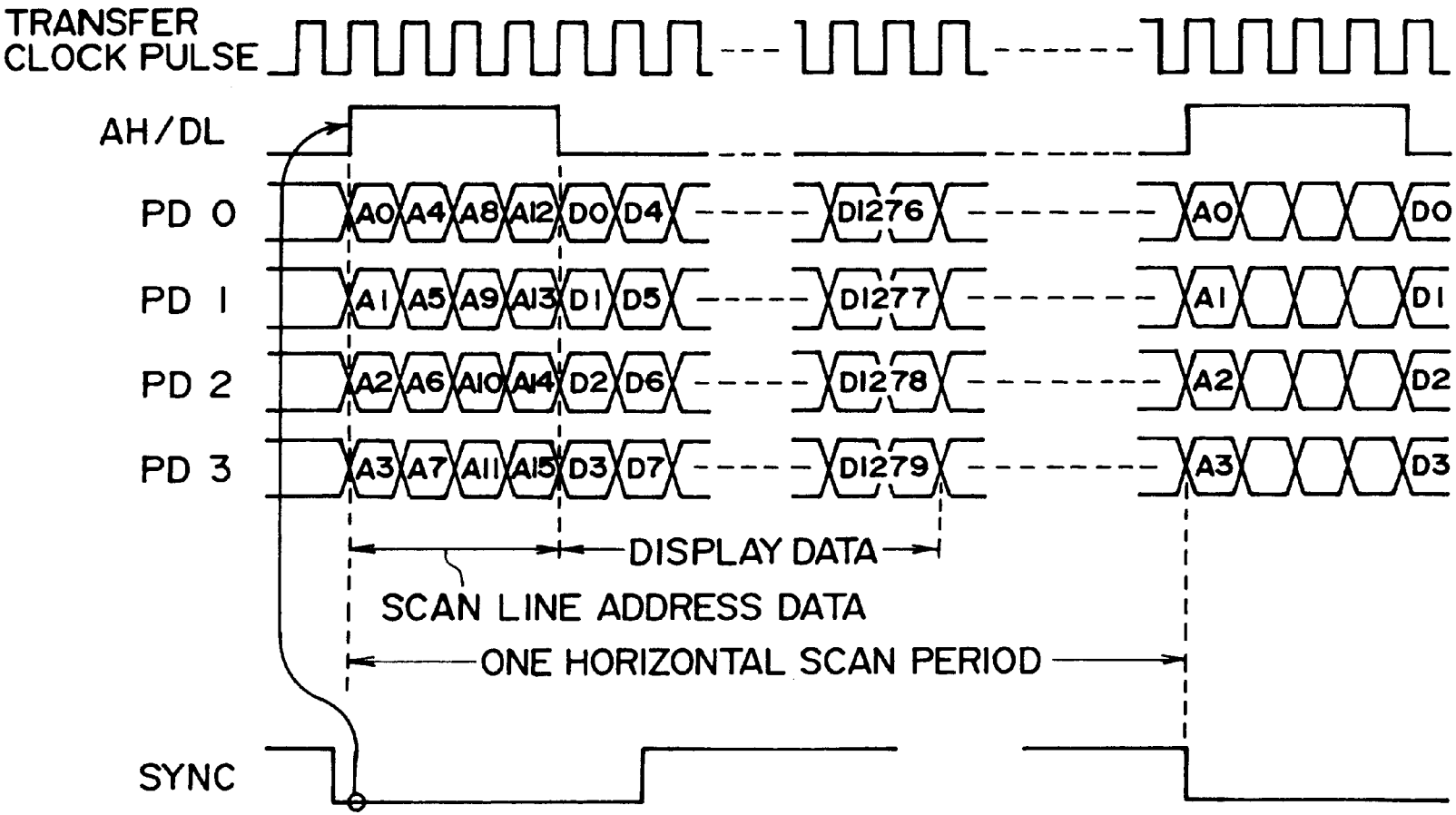
FIG. 19 is a time chart for the drive circuit shown in FIG. 16.

FIG. 16 is a block diagram of a control system for a display apparatus according to the present invention, and FIG. 19 is a time chart for communication of image data therefor. Hereinbelow, the operation of the apparatus will be described with reference to these figures.

A graphic controller 102 supplies scanning line address data for designating a scanning electrode and image data PD0–PD3 for pixels on the scanning line designated by the address data to a display drive circuit constituted by a scanning line drive circuit 104 and a data line drive circuit 105 of a liquid crystal display apparatus 101. In this embodiment, scanning line address data (A0–A15) and display data (D0–D1279) must be differentiated. A signal AH/DL is used for the differentiation. The AH/DL signal at a high (Hi) level represents scanning line address data, and the AH/DL signal at a low (Lo) level represents display data.

The scanning line address data is extracted from the image data PD0–PD3 in a drive control circuit 111 in the liquid crystal display apparatus 101 outputted to the scanning line drive circuit 104 in synchronism with the timing of driving a designated scanning line. The scanning line address data is inputted to a decoder 106 within the scanning line drive circuit 104, and a designated scanning electrode within a display panel is driven by a scanning signal generation circuit 107 via the decoder 106. On the other hand, display data is introduced to a shift register 108 within the data line drive circuit 105 and shifted by four pixels as a unit based on a transfer clock pulse. When the shifting for 1280 pixels on a horizontal one scanning line is completed by the shift register 108, display data for the 1280 pixels are transferred to a line memory 109 disposed in parallel, memorized therein for a period of one horizontal scanning period and outputted to the respective data electrodes from a data signal generation circuit 110.

Further, in this embodiment, the drive of the display panel 103 in the liquid crystal display apparatus 101 and the generation of the scanning line address data and display data in the graphic controller 102 are performed in a non-synchronous manner, so that it is necessary to synchronize the graphic controller 102 and the display apparatus 101 at the time of image data transfer. The synchronization is performed by a signal SYNC which is generated for each one horizontal scanning period by the drive control circuit 111 within the liquid crystal display apparatus 101. The graphic controller 102 always watches the SYNC signal, so that image data is transferred when the SYNC signal is at a low level and image data transfer is not performed after transfer of image data for one scanning line at a high level. More specifically, referring to FIG. 16, when a low level of the SYNC signal is detected by the graphic controller 102, the AH/DL signal is immediately turned to a high level to start the transfer of image data for one horizontal scanning line. Then, the SYNC signal is turned to a high level by the drive control circuit 111 in the liquid crystal display apparatus 101. After completion of writing in the display panel 103 with lapse of-one horizontal scanning period, the drive control circuit 111 again returns the SYNC signal to a low level so as to receive image data for a subsequent scanning line.

Figure 17:
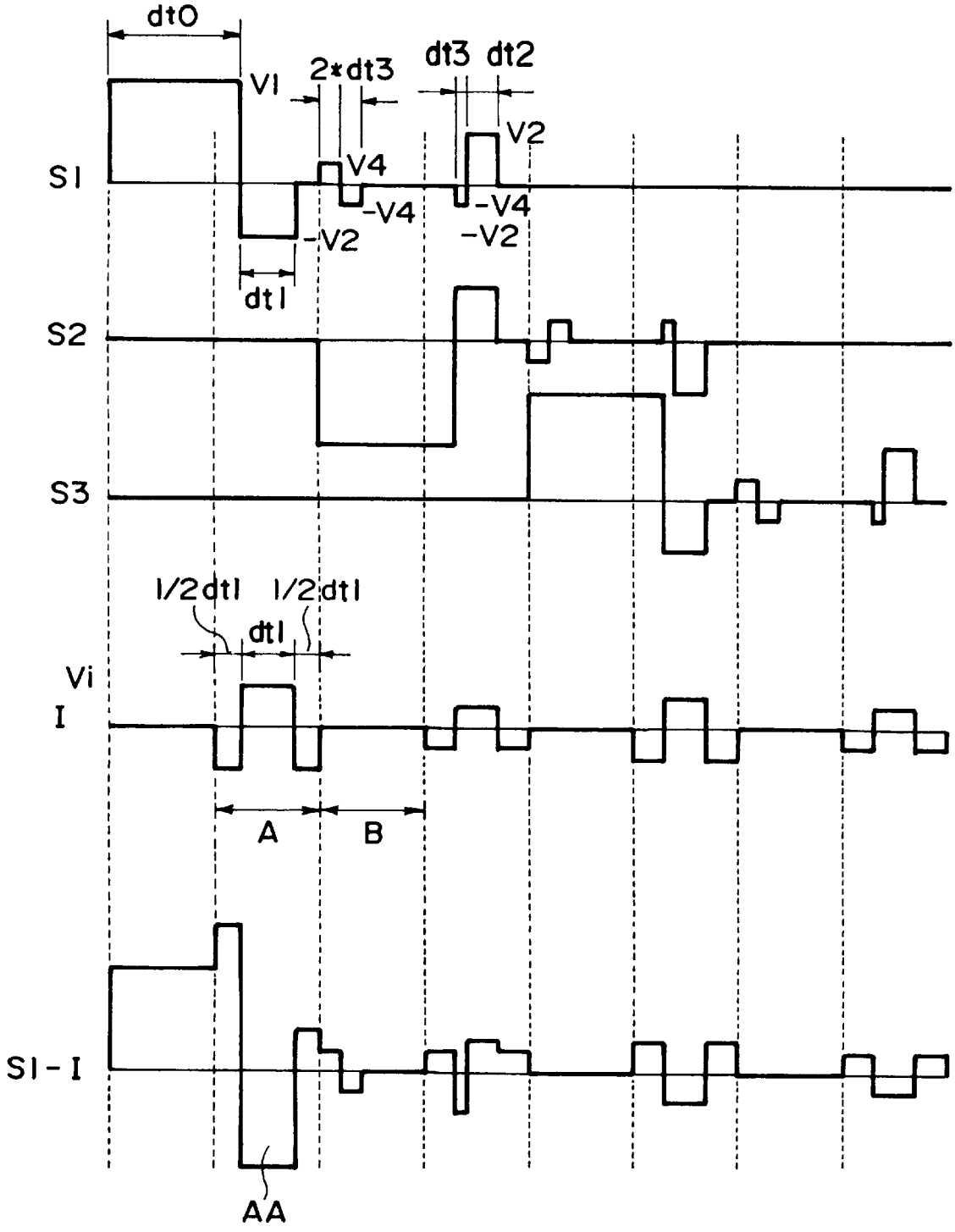
FIG. 17 is a drive waveform diagram showing a set of drive waveforms used in Example 1.

FIG. 17 is a waveform diagram showing a set of driven signal waveforms used in this embodiment including scanning signals applied to scanning lines $S_1, \ldots, S_3, \ldots$, data signals applied to a data line I, and a combined voltage signal applied to a pixel at $S_1$-I.

In this embodiment, a gradation drive scheme according to the pixel shift method was adopted, so that adjacent two scanning lines were supplied with scanning signals having mutually reverse polarities at corresponding phases.

Referring to FIG. 17, the respective pulses were characterized by parameters of $dt_1$=40 μsec, $dt_2$ =27 μsec, $dt_3$=13 μsec, $|V_1|$=20.0 volts, $|V_2|$=17.2 volts, Vi=3.4 volts to −3.4 volts, and $|V_4|$=4.0 volts.

The data signal modulation was effected as voltage modulation so as to provide 0% at ($V_2$+Vi)=13.8 volts, 100% at ($V_2$+$V_i$)=20.6 volts and a halftone at an intermediate voltage. In FIG. 17, the data signal is represented as a signal at a period A applied to a data line I including a gradation data -carrying pulse having an amplitude Vi and a pulse width $dt_1$ and auxiliary pulses on both sides each having a pulse width ½·$dt_1$ for removing the DC component. The relationship between the voltage $V_{LC}$ (=$V_2$+Vi) applied to a pixel (i.e., liquid crystal layer) and the resultant transmittance T (%) was as shown below:

| $V_{LC}$ | 1.38 | 14.4 | 15.0 | 15.6 | 16.2 | 16.8 | 17.5 |
|---|---|---|---|---|---|---|---|
| T(%) | 0 | 10 | 20 | 30 | 40 | 50 | 60 |

| | | | |
|---|---|---|---|
| 18.2 | 19.0 | 19.8 | 20.6 |
| 70 | 80 | 90 | 100 |

Figure 12A:
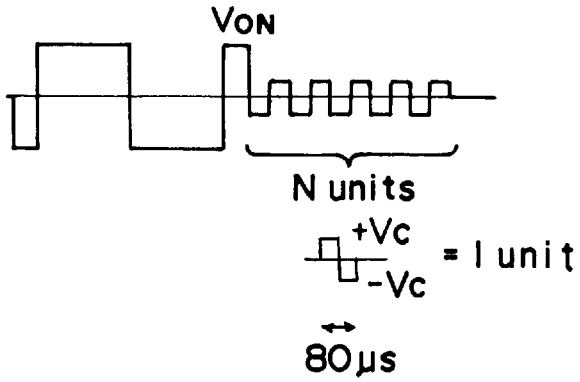
Figure 12B:
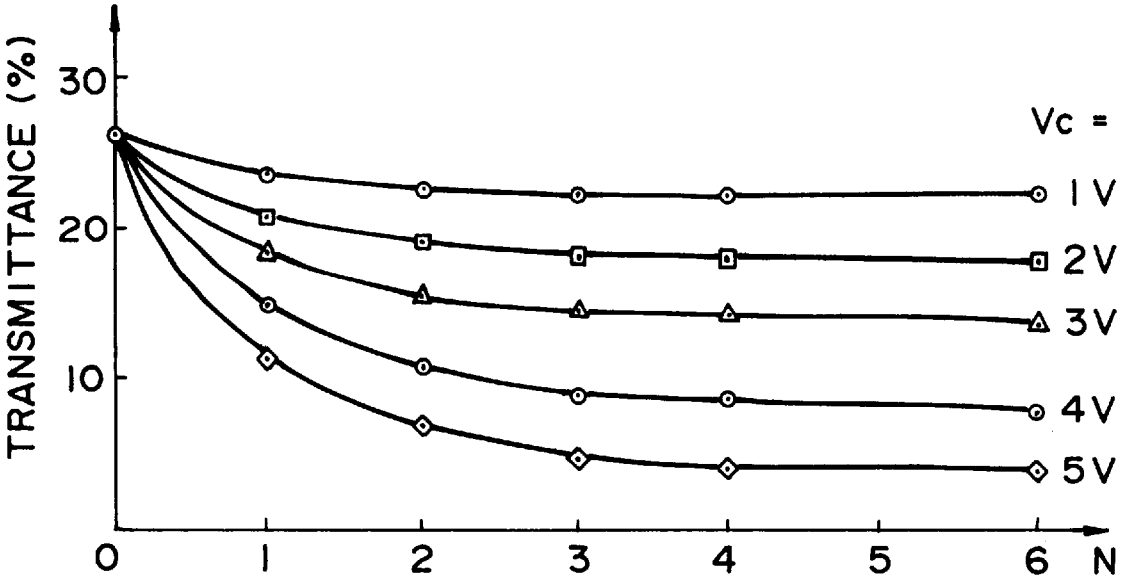

The influence of the crosstalk is most pronounced for a time up to 100 μsec from the falling down of the writing pulse (FIG. 10B) and, in the case of repetitive pulses, up to 30 cycles (6 pulses) have a significant influence but pulses thereafter have little influence (FIG. 12B).

Accordingly, while it can depend to some extent on the alignment state of the liquid crystal, the influence of crosstalk can be minimized by detecting the data for 1–2 lines after application of a pulse AA shown at S1 - I in FIG. 17.

More specifically, if the potential immediately after the pulse after the period A is fixed as shown for a period B (or known in anyway), the influence of the crosstalk can be removed substantially by controlling the applied voltage for a line concerned based on data for one subsequent line. For example, if alternating pulses of ±3 volts and 20 μs are applied after the application of the pulse AA, the writing voltage for an n-th line may be determined from writing data for a subsequent (n+1)-th line in the following manner. That is, in a data conversion circuit within the graphic controller 102 shown in FIG. 16, image data for 1 frame is stored in a frame memory (I) and then, based on the image data, conversion data for displaying an image corresponding to the image data under the influence of the crosstalk is derived starting from a final scanning line and is stored in a frame memory (2). The converted data for the final scanning line is obtained by applying a constant data signal for a one horizontal scanning period. In this way, the conversion data is sequentially obtained up to the starting line and is stored in the image memory (II) as described above. Such conversion data can be obtained regardless of a particular scanning scheme. The above data conversion is effected for respective data lines.

Figure 18:
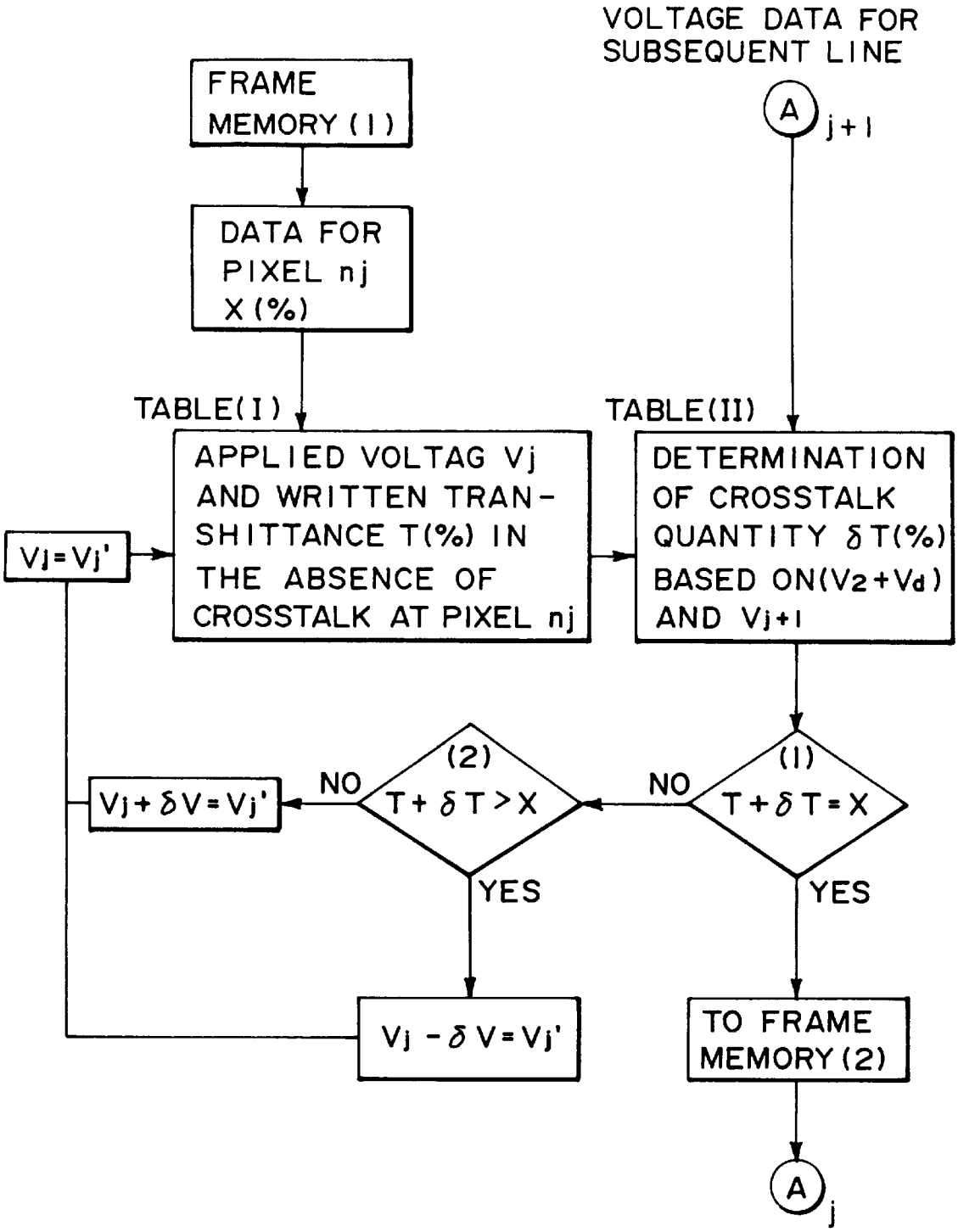
FIG. 18 is a flow chart for illustrating a sequence applied to an embodiment of the invention.

More specifically, the conversion of "image data" into "image data taking the crosstalk into account" may be performed in a manner as illustrated in FIG. 18 for each data line, i.e., for determining conversion data for a pixel $n_j$ on a j-th scanning line from image data for a pixel, $n_{j+1}$ on a j+1-th scanning line and the same data line, in the following manner.

FIG. 18 is a flow chart for illustrating an operation in the data conversion circuit as a comparison-determination circuit used in the present invention. As shown in FIG. 18, the following steps are performed sequentially.

(1) Image data X for $n_j$ is obtained.

(2) Data signal $V_j$ for displaying X without considering crosstalk is determined [TABLE I].

(3) Display data T for the input Vj is determined (T is initially set to X) [TABLE I].

(4) Crosstalk quantity ST is determined from a data signal $V_{j+1}$ and Vj determined in step (2).

(5) A relationship between T determined in step (3) and X given in step (1) is examined. According to judgment ①, if T+δT=×(YES), the voltage for $n_j$ is determined at Vj which is stored in the frame memory (II), and the process for determining $V_{j+1}$ for a subsequent line is started. If the answer to the judgment ① is NO, the judgment ② (if T+δT>X) is performed and, if the answer is YES, Vj'=Vj+δV (fixed value) is substituted for Vj (i.e., Vj=Vj').

If the answer to the judgment ② is NO, Vj'=Vj+δV (fixed value) is substituted for Vj.

(6) Then, the steps (3)–(5) are repeated until the judgment ① is answered by YES.

According to the above process, it is possible to write one picture as desired corresponding to input image data. Herein, TABLE (I) contains data giving a relationship between transmittance and input data signal in the absence of crosstalk, and TABLE (II) contains data for deriving crosstalk quantity from data signal $V_{j+1}$ for a subsequent line and writing signal $V_{ON}=V_2\pm Vj$.

TABLE (II) in this embodiment was given by the following equation:

$$T=26.7\times V_{j+1}/(V_2+Vj)-1.3,$$

wherein $V_2$ ($=V_S$) denotes a scanning signal voltage, Vj denotes a data signal voltage and $V_{j+1}$ denotes a data signal voltage for a subsequent line.

As described hereinabove, according to the present invention, it has become possible to realize a good quality of gradational display free from crosstalk.

What is claimed is:

1. A liquid crystal display apparatus, including:

a liquid crystal display device comprising a pair of oppositely disposed electrode plates having thereon a group of scanning lines and a group of data lines, respectively, and a liquid crystal disposed between the pair of electrode plates so as to form a pixel at each intersection of the scanning lines and data lines, and drive means including:

a drive circuit for sequentially selecting the scanning lines and for applying drive voltages for pixels on the selected scanning line, a first frame memory for storing data signals for the pixels on all the scanning lines, a circuit for correcting data signals stored in the first frame memory for pixels on an n-th scanning line, n being an integer representing a scanning line number according to an order of selection, based on data signals for pixels on at least a subsequently selected scanning line so as to reduce crosstalk at the pixels on the n-th scanning line, and a second frame memory for storing corrected data signals for the pixels on all the scanning lines, said drive circuit applying drive voltages to the data lines based on the corrected data signals for the pixels on the n-th scanning line when the n-th scanning line is selected.

2. An apparatus according to claim 1, wherein said liquid crystal is a chiral smectic liquid crystal.

3. An apparatus according to claim 1, wherein said liquid crystal has ferroelectricity.

4. An apparatus according to claim 1, wherein said image data includes gradational display data.

5. An apparatus according to claim 1, wherein the corrected data signals stored in the second frame memory are sent to a graphic controller.

6. An apparatus according to claim 5, wherein the graphic controller supplies a clock signal together with the data signals to a drive control circuit.

7. An apparatus according to claim 6, wherein the drive control circuit supplies scanning line address data and display data to the drive circuit.

8. An apparatus according to claim 1, wherein said drive circuit supplies a scanning line selection voltage and the drive voltages to the liquid crystal display device based on a scanning line address data and display data inputted thereto.

* * * * *

UNITED STATES PATENT AND TRADEMARK OFFICE

CERTIFICATE OF CORRECTION

PATENT NO. : 5,973,657

DATED : October 26, 1999

INVENTOR(S) : LIQUID CRYSTAL DISPLAY APPARATUS

It is certified that error appears in the above-identified patent and that said Letters Patent is hereby corrected as shown below:

ON TITLE PAGE AT [57] ABSTRACT

Line 12, "a" should be deleted.

SHEET 2

Figure 1A:
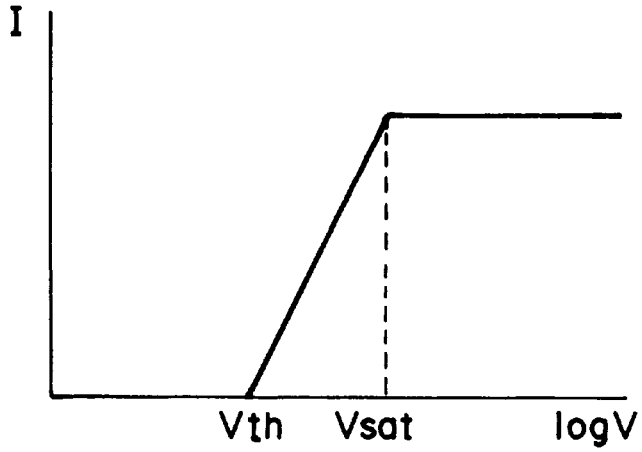
FIGS. 1A and 1B are graphs illustrating a relationship between switching pulse voltage and a transmitted light quantity contemplated in a conventional areal modulation method.
Figure 1B:
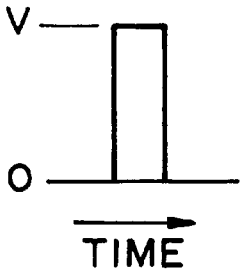
Figures 2A, 2B, 2C, 2D:
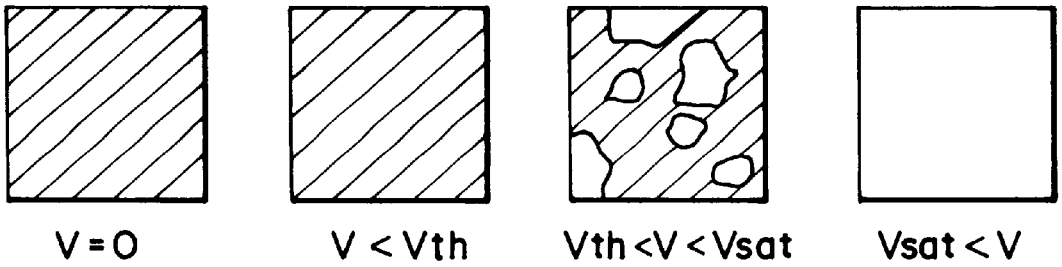
FIGS. 2A–2D illustrate pixels showing various transmittance levels depending on applied pulse voltages.
Figure 3:
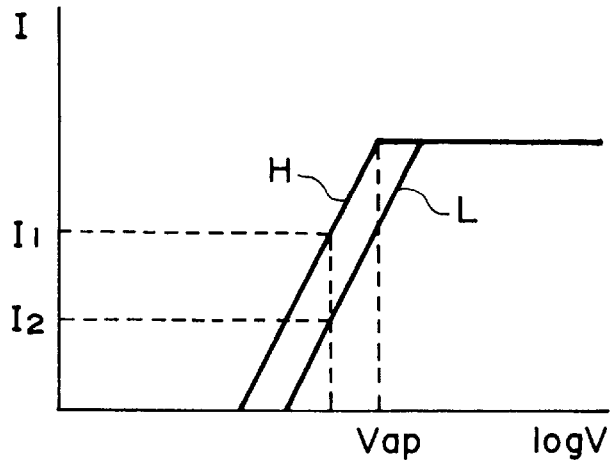
FIG. 3 is a graph for describing a deviation in threshold characteristic due to a temperature distribution.
Figure 4:
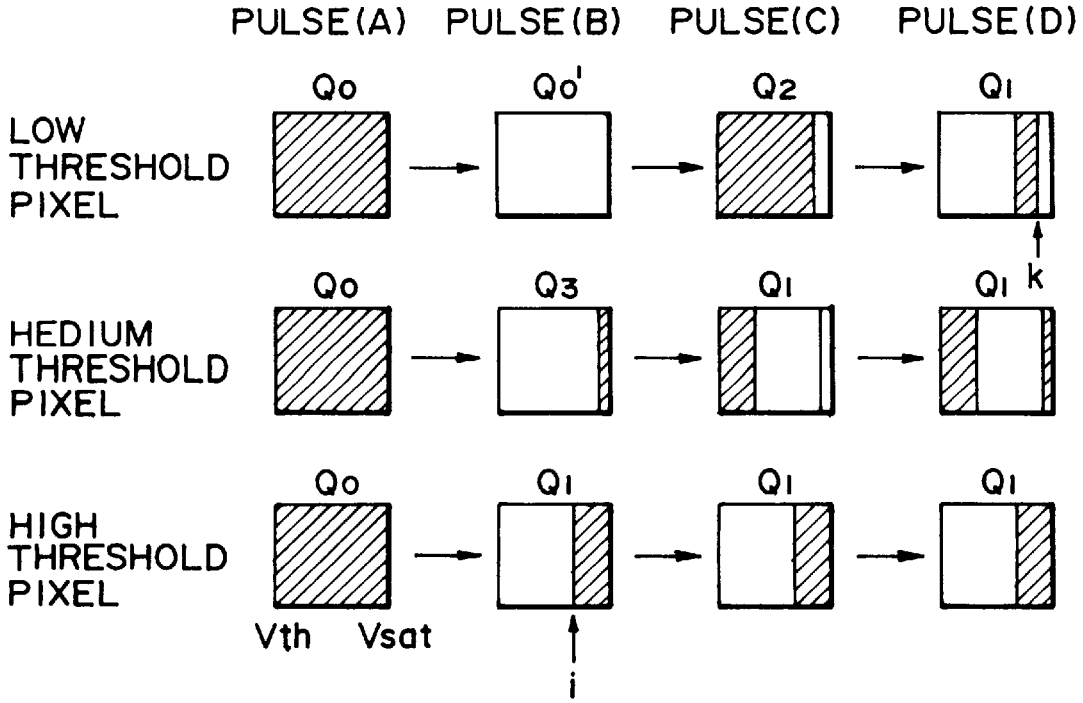
FIG. 4 is an illustration of pixels showing various transmittance levels given in the conventional four-pulse method.
Figure 5:
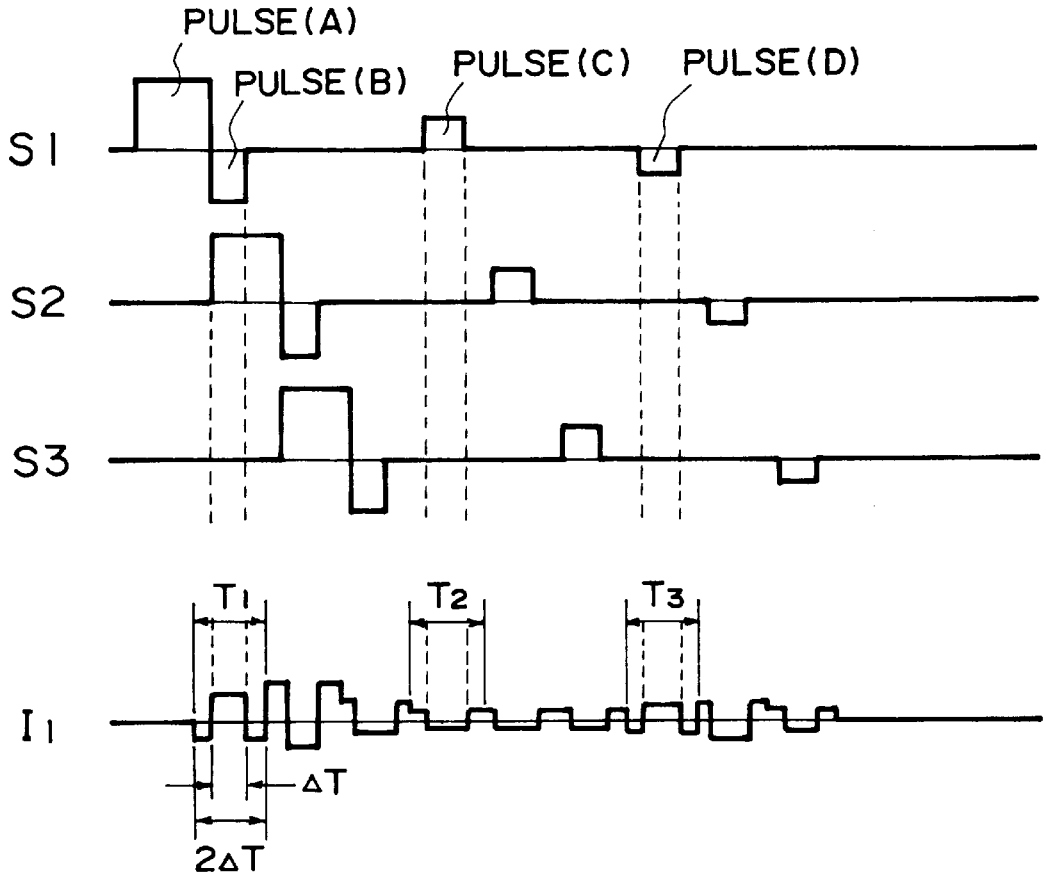
FIG. 5 is a time chart for describing the four-pulse method.

Figure 4, "HEDIUM" should read --MEDIUM--.

SHEET 14

Figure 18, "VOLTAG" should read --VOLTAGE-- and
"TRAN-" should read --TRANS---;
"SHITTANCE" should read --MITTANCE--.

COLUMN 1

Line 4, "08,166,946" should read --08/166,946--;
Line 36, "known-one" should read --known one--;
Line 37, "of-transparent" should read --of transparent--;
Line 46, "above-type" should read --above type--;
Line 56, "show" should read --shows--.

COLUMN 2

Line 7, "al" should read --al.--.

COLUMN 3

Line 3, "four" should read --"four--;
Line 34, "may for example" should read
--may, for example,--;
Line 40, "saw-teeth" should read --saw-tooth--.

UNITED STATES PATENT AND TRADEMARK OFFICE

CERTIFICATE OF CORRECTION

PATENT NO. : 5,973,657

DATED : October 26, 1999

INVENTOR(S) : LIQUID CRYSTAL DISPLAY APPARATUS

It is certified that error appears in the above-identified patent and that said Letters Patent is hereby corrected as shown below:

COLUMN 5

Line 25, "10A<a" should read --10A, a--;
Line 29, "μμm" should read --μm--;
Line 45, "Example" should read --the Example--;
Line 48, "When the" should read --The--.

COLUMN 7

Line 31, "VON" should read --$V_{ON}$--;
Line 49, "an" should read --a--;
Line 61, "Based" should read --based--;
Line 66, "it" should read --It--.

COLUMN 8

Line 4, "saw-teeth" should read --saw-tooth--;
Line 10, "an about" should read --about a--.

UNITED STATES PATENT AND TRADEMARK OFFICE

CERTIFICATE OF CORRECTION

PATENT NO. : 5,973,657

DATED : October 26, 1999

INVENTOR(S) : LIQUID CRYSTAL DISPLAY APPARATUS

It is certified that error appears in the above-identified patent and that said Letters Patent is hereby corrected as shown below:

COLUMN 9

Line 38, "of-one" should read --of one--.

Signed and Sealed this

Third Day of April, 2001

Nicholas P. Godici

*Attest:*

NICHOLAS P. GODICI

*Attesting Officer*

*Acting Director of the United States Patent and Trademark Office*